US009397406B2

(12) United States Patent
Grange et al.

(10) Patent No.: US 9,397,406 B2
(45) Date of Patent: Jul. 19, 2016

(54) ARTIFICIAL MAGNETIC CONDUCTOR, AND ANTENNA

(75) Inventors: Francois Grange, Moirans (FR); Christophe Delaveaud, Moirans (FR); Bernard Viala, Sassenage (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 550 days.

(21) Appl. No.: 13/883,309

(22) PCT Filed: Oct. 27, 2011

(86) PCT No.: PCT/EP2011/068818

§ 371 (c)(1),
(2), (4) Date: Jul. 15, 2013

(87) PCT Pub. No.: WO2012/059391

PCT Pub. Date: May 10, 2012

(65) Prior Publication Data

US 2013/0285858 A1 Oct. 31, 2013

(30) Foreign Application Priority Data

Nov. 3, 2010 (FR) ..... 10 59034

(51) Int. Cl.
*H01Q 1/38* (2006.01)
*H01Q 15/00* (2006.01)
*H01F 10/32* (2006.01)

(52) U.S. Cl.
CPC ..... *H01Q 15/0013* (2013.01); *H01F 10/3218* (2013.01); *H01Q 15/006* (2013.01); *Y10T 428/2495* (2015.01)

(58) Field of Classification Search
USPC ..... 343/700 MS, 702, 909
See application file for complete search history.

(56) References Cited

U.S. PATENT DOCUMENTS

2003/0231142 A1 12/2003 McKinzie, III et al.
2004/0140945 A1* 7/2004 Werner ..... H01Q 15/0086 343/909
2005/0030137 A1 2/2005 McKinzie, III et al.

(Continued)

FOREIGN PATENT DOCUMENTS

FR 2939990 12/2008
WO WO99/50929 10/1999

OTHER PUBLICATIONS

Francois Grange et al: "Miniaturization of artificial magnetic conductors", Antennas and Propagation Societyinternational Symposium (APSURSI) , 2010 IEEE, (Jul. 11, 2010) , pp. 1-4.

(Continued)

*Primary Examiner* — Hoang V Nguyen
*Assistant Examiner* — Hai Tran
(74) *Attorney, Agent, or Firm* — Occhiuti & Rohlicek LLP

(57) ABSTRACT

An artificial magnetic conductor having a surface impedance greater than 100Ω, includes a ground plane, and a frequency-selective surface that is transparent for certain wavelengths and reflective for a range of wavelengths. The frequency-selective surface includes an array of conductive resonant elements arranged alongside one another in at least two different directions parallel to the ground plane. Each of these conductive resonant elements includes a sub-layer of ferromagnetic material having a relative permeability greater than 10 at a frequency of 2 GHz and having a thickness less than the skin thickness of the ferromagnetic material.

11 Claims, 4 Drawing Sheets

(56) References Cited

U.S. PATENT DOCUMENTS

| | | | | |
|---|---|---|---|---|
| 2006/0256480 | A1 | 11/2006 | Hayakawa | |
| 2010/0151797 | A1 * | 6/2010 | Viala | B82Y 25/00 455/73 |

OTHER PUBLICATIONS

Bell J Met al: "Ultra-Wideband and Low-Profile Hybrid EBG/Ferrite Ground Plane for Airborne Foliage Penetrating Radar", Antennas and Propagation Society International Symposium, IEEE (Jul. 9, 2006), pp. 369-372.

McKinzie We et al: "Experimental results of an AMC antenna fabricated with a magnetically-loaded elastomeric substrate" , Antennas and Propagation Society International Symposium, IEEE, (Jul. 5, 2008), pp. 1-4.

Diaz R et al: "Magnetic loading of artificial magnetic conductors for bandwidth enhancement", IEEE Antennas and Propagation Society International Symposium. 2003 Digest. vol. 2, 22 (Jun. 22, 2003), pp. 431-434.

Foroozesh A et al: "Size Reduction of a Microstrip Antenna with Dielectric Superstrate using Meta-Materials: Artificial Magnetic Conductors versus Magneto-Dielectrics", Antennas and Propagation Society International Symposium 2006, IEEE, (Jul. 9, 2006), pp. 11-14.

* cited by examiner

ARTIFICIAL MAGNETIC CONDUCTOR, AND ANTENNA

RELATED APPLICATIONS

Under 35 USC 371, this is the national stage entry of PCT/EP2011/068818, filed on Oct. 27, 2011, which claims the benefit of the priority date of FR 1059034, filed Nov. 3, 2010, the contents of which are incorporated herein by reference in their entirety.

FIELD OF INVENTION

The invention relates to an artificial magnetic conductor and an antenna incorporating this artificial magnetic conductor.

BACKGROUND

The artificial magnetic conductors are better known by their acronym AMC. For more information on the principles of operation of these artificial magnetic conductors and their physical properties, reference can be made to the patent application WO 99 509 29 filed by Sievenpiper.

Typically, the artificial magnetic conductors exhibit two characteristic properties:

- a high surface impedance $Z_s$ in a range of frequencies called "passband", and
- a resonance frequency $f_0$, contained in the passband, for which the phase-shift is zero between an incident electromagnetic wave on the artificial magnetic conductor and the reflected electromagnetic wave.

The surface impedance $Z_s$ is defined by the following ratio: $Z_s=E_{tan}/H_{tan}$, in which:

- $E_{tan}$ is the component of the electrical field of the incident electromagnetic wave tangential to the face of the artificial magnetic conductor, and
- $H_{tan}$ is the component of the magnetic field of the incident electromagnetic wave tangential to the surface of the artificial magnetic conductor.

A surface impedance $Z_s$ is said to be "high" if its modulus is greater than the vacuum wave impedance (modulus of $Z_s$>377 Ohms) and, preferably, several times greater than the vacuum wave impedance.

Known artificial magnetic conductors comprise:

- a ground plane,
- at least one first frequency-selective surface, transparent for certain wavelengths and reflecting for a range of wavelengths, this frequency-selective surface comprising an array of conductive resonant elements arranged alongside one another in at least two different directions parallel to the ground plane.

These artificial magnetic conductors are used to produce antennas. For example, known antennas comprise:

- an artificial magnetic conductor exhibiting a resonance frequency $f_0$,
- a radiant conductor suitable for radiating or for receiving electromagnetic waves at a working frequency $f_T$ of between $0.5f_0$ and $2f_0$, this conductor extending in a plane parallel to the artificial magnetic conductor and being separated from the closest frequency-selective surface of this artificial magnetic conductor by a distance less than $\lambda_0/10$, in which $\lambda_0$ is the wavelength of an electromagnetic wave of frequency $f_0$.

There is a strong demand to miniaturize the antennas. These days, it is possible to use radiant conductors with a length less than $\lambda_T/4$ or $\lambda_T/10$, where $\lambda_T$ is the wavelength at the working frequency $f_T$ of the antenna. It is therefore also desirable to reduce the size and the footprint of the artificial magnetic conductors. For this, the dimensions of the resonant elements have to be reduced. Now, when the dimensions of the resonant elements are reduced, the passband of the artificial magnetic conductor also decreases. This is not desirable.

Moreover the lower the resonance frequency $f_0$ desired for the artificial magnetic conductor, the greater the size of the resonant elements. Thus, to miniaturize an artificial magnetic conductor, it is also desirable to have resonant elements which, with a size equal to the resonant elements of the known artificial magnetic conductors, make it possible to obtain a lower resonance frequency $f_0$.

SUMMARY

The invention aims to remedy these problems by proposing an artificial magnetic conductor which, with equal size for the resonant elements, exhibits a wider passband or which, with equal passband, uses smaller resonant elements.

Its subject is therefore an artificial magnetic conductor in which each resonant element is formed by at least one sublayer of ferromagnetic material with a relative permeability greater than 10 for a frequency of 2 GHz and with a thickness strictly less than the skin thickness of this ferromagnetic material.

The use of a ferromagnetic material to produce the resonant elements makes it possible to reduce the resonance frequency $f_0$ compared to the case of the artificial magnetic conductors produced only with metallic resonant elements.

Furthermore, the use of a ferromagnetic material makes it possible to increase the passband of the artificial magnetic conductor relative to an artificial magnetic conductor that is identical but in which the resonant elements are produced only in metal.

Thus, the resonant elements provided with a ferromagnetic sublayer make it possible to miniaturize the artificial magnetic conductor.

The fact that the sublayer of ferromagnetic material has a thickness less than the skin thickness makes it possible to avoid the magnetization relaxation mechanisms that are likely to result in a drop in the permeability and to strong magnetic losses, in the artificial magnetic conductor and makes the use of this sublayer of ferromagnetic material possible.

The embodiments of this artificial magnetic conductor may comprise one or more of the following features:

- at least each resonant element of the first frequency-selective surface is formed by a stack of several sublayers, each sublayer having a thickness of less than 10 μm in a direction at right angles to the ground plane;
- at least one of the sublayers of each resonant element is a sublayer of dielectric material exhibiting a relative permittivity greater than 10 for a frequency of 2 GHz;
- at least one of the sublayers of each resonant element is an antiferromagnetic sublayer directly deposited on or under the ferromagnetic sublayer;
- at least one of the sublayers of each resonant element is a metal sublayer;
- the artificial magnetic conductor comprises n frequency-selective surfaces stacked one on top of the other in a direction at right angles to the ground plane, each of these frequency-selective surfaces comprising an array of conductive resonant elements arranged alongside one another in at least two different directions parallel to the ground plane and separated from one another by a layer of dielectric material with a thickness strictly greater than 10 μm, where n is an integer greater than or equal to two;

each resonant element of each of the n frequency-selective surfaces is formed by at least one sublayer of ferromagnetic material with a relative permeability greater than 10 for a frequency of 2 GHz and with a thickness strictly less than the skin thickness of this ferromagnetic material;

each resonant element is electrically insulated from the ground plane by a layer of dielectric material;

each resonant element extends mainly in a plane which forms an angle with the ground plane of between 5° and 45°.

These embodiments of the artificial magnetic conductor also offer the following advantages:

the use of a sublayer of dielectric material exhibiting a relative permittivity greater than 10 makes it possible to increase the miniaturization of the artificial magnetic conductor;

the use of an antiferromagnetic sublayer also makes it possible to increase the passband;

the use of a metal sublayer makes it possible to limit the ohmic losses in the artificial magnetic conductor;

the use of several frequency-selective surfaces makes it possible to reduce the resonance frequency $f_0$ of the artificial magnetic conductor without increasing the size of the resonant elements;

the use of sublayers of ferromagnetic material to form each of the resonant elements of each of the stacked frequency-selective surfaces increases the passband and further reduces the resonance frequency $f_0$;

electrically insulating the resonant elements from the ground plane makes it possible to avoid having to produce conductive vertical contact blocks linking the resonant elements to the ground plane which simplifies the fabrication of the artificial magnetic conductor.

Another subject of the invention is an antenna comprising the above artificial magnetic conductor.

BRIEF DESCRIPTION OF THE FIGURES

The invention will be better understood on reading the following description, given purely as a nonlimiting example and with reference to the drawings in which.

In these figures, the same references are used to designate the same elements.

DETAILED DESCRIPTION

Hereinafter in this description, the features and functions that are well known to the person skilled in the art are not described in detail.

The real part of the relative permeability and of the relative permittivity are physical quantities which vary as a function of frequency. Here, unless indicated otherwise, the expressions "relative permeability"/"relative permittivity" are used to denote the value of the real part of this physical quantity for a frequency of 2 GHz. However, what is described here applies also to the case where these relative permeability and relative permittivity values are given for a frequency of 1 GHz.

Figure 1:
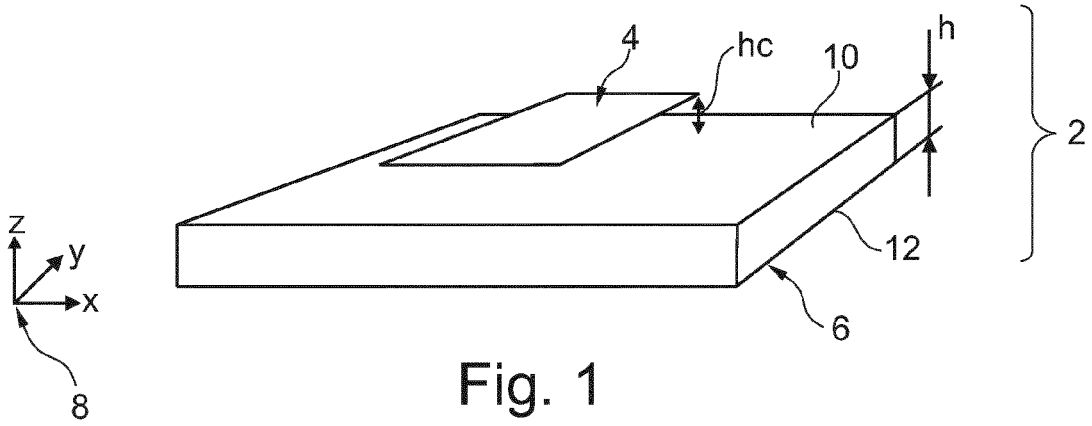
FIG. 1 is a schematic illustration in perspective of an antenna comprising an artificial magnetic conductor.

FIG. 1 represents an antenna 2 equipped with a radiant conductor 4 arranged above an artificial magnetic conductor 6 extending horizontally.

In this description, the figures are oriented relative to a reference frame 8 comprising two orthogonal horizontal directions X and Y and a vertical direction Z. The terms "up"/"down", "above"/"below" and "top"/"bottom" are defined relative to this direction Z.

The antenna 2 is suitable for transmitting and/or receiving electromagnetic waves at a working frequency $f_T$ corresponding to a wavelength of $\lambda_T$. Typically, the frequency $f_T$ is between 100 MHz and 20 GHz and, preferably, between 1 GHz and 10 GHz.

The antenna 2 essentially transmits electromagnetic waves in the half-space above the plane XY. Here, the main direction of transmission/reception is at right angles to the plane XY and matches the direction Z.

Here, the artificial magnetic conductor 6 is in the form of a plate extending mainly horizontally. This plate has an upward-facing front face 10 and a downward-facing rear face 12. Here, these faces 10 and 12 are horizontal. The face 12 is contained in the plane XY. In the particular case described here, the artificial magnetic conductor 6 is in the form of a horizontal rectangular plate.

The artificial magnetic conductor 6 exhibits a frequency band, called "passband", within which the electromagnetic waves are reflected without phase reversal (phase≠180°). Thus, in the passband, the interferences between the incident and reflected waves on the conductor 6 are constructive whereas they are destructive outside of this passband. More specifically, here, the passband of an artificial magnetic conductor is defined as being the frequency band for which the phase of the electromagnetic wave reflected on this artificial magnetic conductor is phase-shifted by an angle β of between −90° and +90° relative to the incident electromagnetic wave on this same artificial magnetic conductor.

For a particular frequency of this passband, called resonance frequency $f_0$, the angle β is zero. For this frequency $f_0$ the coefficient of reflection of the component of the electrical field tangential to the face 10 is equal to +1. By comparison, on a metal plane, this coefficient of reflection is equal to −1.

The artificial magnetic conductor 6 limits or prevents the propagation of the electromagnetic waves in the half-space situated below the plane XY for the transmission and reception frequencies situated in the passband of the artificial magnetic conductor 6.

Hereinafter in this description, the examples given of dimensions for the different constituent elements of the artificial magnetic conductor 6 are given for a resonance frequency $f_0$ equal to or close to 6 GHz.

The artificial magnetic conductor 6 also exhibits a high surface impedance $Z_s$ preventing or limiting the appearance of surface current. This limits the losses of the antenna 2. Here, the modulus of the impedance $Z_s$ is greater than the vacuum wave impedance (modulus of $Z_s$>377 Ohms) and, preferably, two or ten times greater than the vacuum wave impedance. The impedance $Z_s$ of the artificial magnetic conductor 6 is mainly high within its passband.

The height h of the conductor 6, that is to say the shortest distance separating the faces 10 and 12, is strictly less than $\lambda_0/4$ and preferably less than $\lambda_0/50$, where $A_0$ is the wavelength corresponding to the resonance frequency $f_0$. For example, the height h is equal to 4 mm.

The radiant conductor 4 extends here essentially in a horizontal plane. It is spaced apart from the front face 10 by a height $h_c$ less than $\lambda_T/4$ and, preferably, less than $\lambda_T/10$ or $\lambda_T/100$.

For example, the space between the radiant conductor 4 and the front face 10 is filled with a dielectric to keep the radiant conductor 4 above this face 10.

Here, the radiant conductor 4 is represented in the form of a conductive rectangular element better known as a "patch". The radiant conductor 4 is dimensioned to transmit and receive at the working frequency $f_T$. This working frequency $f_T$ is between $0.5f_0$ and $2f_0$.

Figure 2:
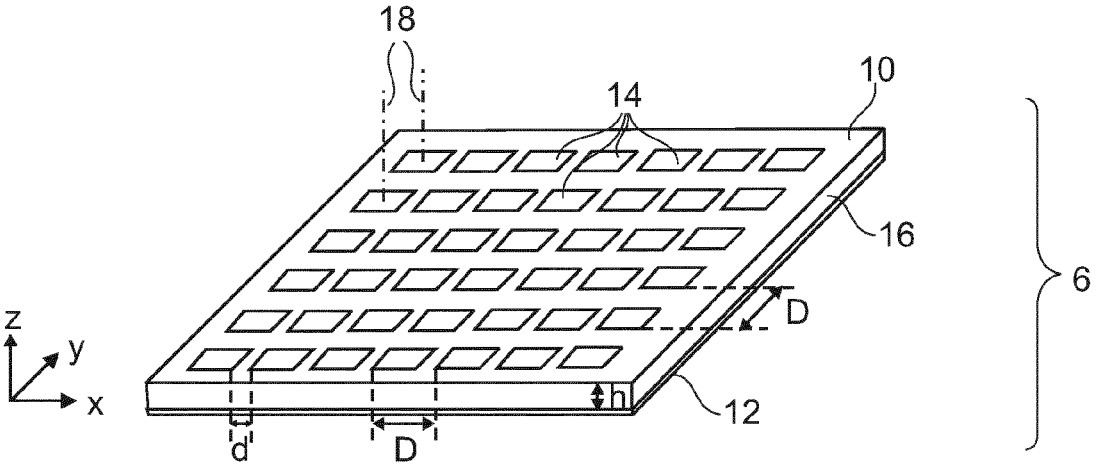
FIG. 2 is a schematic illustration in perspective of the artificial magnetic conductor of the antenna of FIG. 1.

FIG. 2 represents the artificial magnetic conductor 6 in more detail.

The rear face 12 is a ground plane or a substrate with the ground function. This face 12 is therefore formed by a metal leaf that is uniformly and continuously distributed in the plane XY. Typically, it is a metallization layer. For example, the ground plane is made of copper. For example, its thickness is 35 μm.

The face 10 is separated from the face 12 by one or more dielectric layers collectively referenced by the numerical reference 16.

The front face 10 is a frequency-selective surface, better known by the acronym FSS. This face 10 is transparent for the electromagnetic planar waves with a frequency situated outside of the passband of the artificial magnetic conductor 6 and reflecting for the electromagnetic planar waves with a frequency that lies within this passband. However, the face 10 does not necessarily exhibit a photonic band gap.

The face 10 is formed by a two-dimensional array of resonant elements 14. To simplify FIG. 2, the reference 14 is only indicated for a few of these resonant elements. This array of elements 14 is said to be two-dimensional because the elements 14 are aligned alongside one another in two different horizontal directions. Here, the elements 14 are aligned along directions X and Y.

Here, the resonant elements 14 are arranged periodically along the directions X and Y. The period along the directions X and Y is denoted D. This period D is less than $\lambda_0/10$ and, preferably, less than $\lambda_0/50$. In the particular case described here, the periodicities along the directions X and Y are equal. For example, the period D is equal to 4.1 mm.

Each resonant element 14 has a front face exposed to the electromagnetic radiations. Here, the front faces of the different radiant elements 14 are situated in one and the same horizontal plane.

To explain the operation of each resonant element 14, it can be assumed that it operates like a resonant LC circuit. For this, each resonant element 14 is adjacent to another resonant element 14 and capacitively coupled to the other adjacent elements 14. The shortest distance between two consecutive resonant elements 14 along the direction X or Y is denoted "d". This distance d is, for example, equal to 100 μm.

Each resonant element 14 is also inductively coupled to the ground plane 12. Here, this inductive coupling is made through the dielectric layers 16.

In this embodiment, the resonant elements 14 are electrically insulated from the ground plane 12 by the dielectric layers 16. This means, in particular, that there are no vertical conductive contact blocks, known as "vias", directly electrically connecting all or just some of the resonant elements 14 to the ground plane 12.

Each resonant element is produced in a conductive material with a conductivity greater than 100 S/m and, preferably, greater than 1000 S/m or 1 MS/m. Here, the conductivity of the resonant elements 14 is greater than or equal to 5 MS/m.

The horizontal dimensions of the resonant elements 14 are less than $\lambda_0/10$ and, preferably, less than $\lambda_0/50$ or $\lambda_0/100$ in order to appear like a uniform material in front of the incident electromagnetic waves. Furthermore, this makes it possible to repeat each resonant element a large number of times in the direction X or Y.

The thickness of each resonant element is typically less than ten or so micrometers.

Here, each resonant element 14 is in the form of a solid land. Here, each land has a vertical axis 18 of symmetry. For example, in the particular case represented here, each resonant element 14 is a square land.

Figure 3:
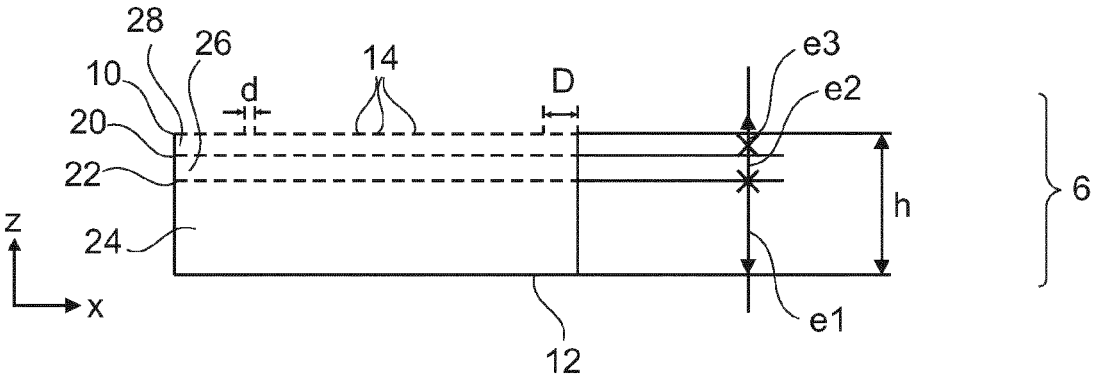
FIG. 3 is a schematic illustration in vertical cross section of a portion of the artificial magnetic conductor of FIG. 2.
Figure 4:
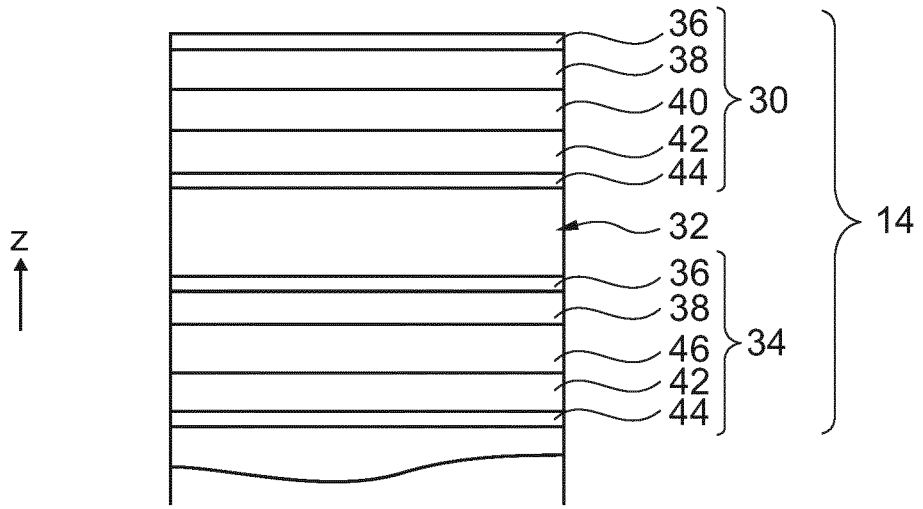
FIG. 4 is a schematic illustration in vertical cross section of a resonant element of the artificial magnetic conductor of FIG. 2.

FIG. 3 represents a vertical section of the artificial magnetic conductor 6. This vertical section shows that the artificial magnetic conductor 6 comprises n frequency-selective surfaces stacked one on top of the other in the direction Z where n is an integer greater than or equal to two. In the particular case represented in FIG. 3, n is equal to three such that the artificial magnetic conductor 6 comprises three frequency-selective surfaces, respectively, 10, 20 and 22. The surfaces 10, 20 and 22 are separated from one another by layers of dielectric materials. More specifically, the surface 22 is separated from the ground plane 12 by a layer 24 of dielectric material of thickness $e_1$.

The surface 20 is stacked above the surface 22 and separated from the surface 22 by a layer 26 of dielectric material of thickness $e_2$.

Finally, the surface 10 is stacked above the surface 20 and separated from this surface 20 by a layer of dielectric material 28 of thickness $e_3$.

The thickness of the layers 24, 26 and 28 is strictly greater than 10 μm and, preferably, greater than 50 μm. These thicknesses are also less than $\lambda_0/10$ and preferably less than $\lambda_0/100$ or $\lambda_0/1000$.

In FIG. 3, the thicknesses $e_2$ and $e_3$ are equal and very much less than the thickness $e_1$.

The dielectric materials of the layers 26 and 28 are identical.

The dielectric material of the layer 24 is not necessarily the same as that used to form the layers 26 and 28. For example, here, the dielectric material of the layer 24 is glass.

In the particular case described here, the surfaces 20 and 22 are identical to the surface 10 except that they are not arranged at the same height inside the artificial magnetic conductor 6. Furthermore, the resonant elements 14 of each surface 10, 20 and 22 are aligned vertically one above the other. Thus, the axes of symmetry 18 of the resonant elements of the different surfaces 10, 20 and 22 are the same.

The resonance frequency $f_0$ of the artificial magnetic conductor 6 is notably set by the following parameters:

the number n of frequency-selective surfaces stacked one above the other, the period D of the array of resonant elements, the height h of the artificial magnetic conductor 6, the dimensions of the resonant elements 14, and the relative permittivity of the dielectric layers 20, 22 and 24.

Among these different parameters, the resonance frequency $f_0$ is particularly sensitive to the number n of frequency-selective surfaces and to the period D.

Here, these different parameters are adjusted by trial and error so that the resonance frequency $f_0$ is between 100 MHz and 20 GHz and, preferably, between 1 GHz and 10 GHz. For example, these parameters are determined by electromagnetic simulation for different values of these parameters.

Each resonant element 14 is produced by a stack of thin sublayers. A "thin" sublayer is a sublayer with a thickness less than 10 μm and, preferably, less than 1 μm in the vertical direction. This stack of sublayers is here called composite material.

To increase the passband of the artificial magnetic conductor 6 and reduce its resonance frequency $f_0$, at least one of these sublayers is produced in a ferromagnetic material with a relative permeability greater than 10 and, preferably, greater than 100 at 2 or 3 GHz.

The benefit of a strong permeability for reducing in the size of a resonant element is explained by the following equation:

$$l_{electrical} = \frac{l_{physical}}{\sqrt{\mu_{effective}\varepsilon_{effective}}}$$

in which:

$l_{electrical}$ is the electrical length of the resonant element, $l_{physical}$ is the physical or real length of the resonant element, $\mu_{effective}$ is the relative effective permeability of the material of the resonant element, and $\in_{effective}$ is the relative effective permittivity of the material of the resonant element.

Thus, for one and the same electrical length $l_{electrical}$, the greater the permeability, the shorter the physical length of the resonant element.

More specifically, each resonant element is produced in a composite material simultaneously exhibiting the following properties without the need for an artificial external magnetic field, that is to say a magnetic field other than the Earth's magnetic field:

its conductivity is greater than 100 S/m and, preferably, greater than 1000 S/m or 1 MS/m at 25° C., its relative permeability is greater than 10 and, preferably, greater than 100 in at least one horizontal direction for a frequency of 2 or 3 GHz, its relative permittivity is greater than 10 and, preferably, greater than 100 at 2 or 3 GHz in the same direction as that in which the relative permeability is greater than 10.

Typically, the relative permittivity is the same regardless of the horizontal direction considered.

Such composite materials exhibiting these properties and their fabrication are described in more detail in the patent application FR 2 939 990.

In the particular case described here, this composite material comprises a first grouping 30 of thin ferromagnetic sublayers superposed on a thin insulating sublayer 32 which is in turn superposed on a second grouping 34 of thin ferromagnetic sublayers.

The first grouping 30 of thin ferromagnetic sublayers is made up of the following stack, from top to bottom:

an intermediate sublayer 36 ensuring the interface between a ferromagnetic sublayer and a dielectric sublayer, a ferromagnetic sublayer 38, an antiferromagnetic sublayer 40, a ferromagnetic sublayer 42, and an intermediate sublayer 44.

The sublayer 36 is for example produced in ruthenium (Ru), tantalum (Ta) or platinum (Pt). Its thickness is less than 10 nm.

The sublayer 38 has a thickness less than the skin thickness of the ferromagnetic material and, preferably, less than half or a third of this skin thickness. Here, its thickness is less than 100 nm and, preferably, less than 50 or 25 nm. Such a choice of thickness for the ferromagnetic sublayer limits the magnetic losses of the material.

Typically, the sublayer 38 is produced in an alloy of iron and/or cobalt and/or nickel. It may also be an FeCo alloy or an FeCoB alloy. Here, it is an $Fe_{65}Co_{35}$ alloy.

The antiferromagnetic sublayer 40 is, for example, produced in an alloy of manganese and, notably, in an alloy of manganese and nickel. For example, here, it is an $Ni_{50}Mn_{50}$ alloy. The presence of the antiferromagnetic layer makes it possible to create an exchange coupling in order for the material to be self-polarized and therefore does not require for this the presence of an artificial external magnetic field.

Typically, the thickness of this sublayer 40 is less than 100 nm and, for example, less than 50 nm.

The ferromagnetic sublayer 42 is, for example, identical to the sublayer 38.

Similarly, the intermediate sublayer 44 is, for example, identical to the sublayer 36.

The insulating sublayer 32 is produced in a dielectric material exhibiting a relative permittivity greater than 10 and, preferably, greater than 100 at 2 or 3 GHz. This sublayer is typically produced using an oxide of strontium (Sr) and titanium (Ti). For example, it is strontium titanate ($SrTiO_3$). The thickness of the sublayer 32 is less than 10 μm or 1 μm. It is generally thicker than the ferromagnetic and antiferromagnetic sublayers.

The second grouping 34 is, for example, identical to the first grouping 30 and will therefore not be described in more detail.

The radiant elements 14 are, for example, fabricated by deposition on the dielectric layer 20, 22 or 24 of the thin sublayers one after the other. These sublayers extend over all of the surface of the dielectric layer. Then, the resonant elements 14 are individualized by etching this stack of thin sublayers.

Figure 5:
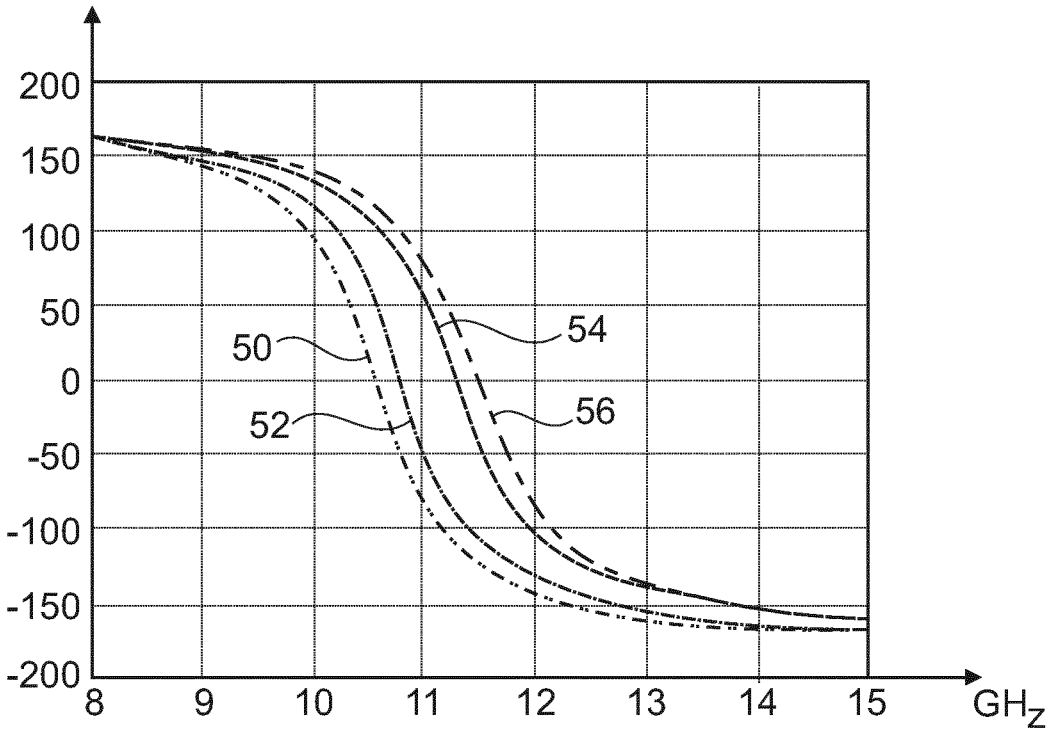
FIG. 5 is a graph illustrating the increase in the passband and the decrease in the resonance frequency of the artificial magnetic conductor when its resonant elements comprise a ferromagnetic sublayer.

FIG. 5 illustrates the trend of the phase of the coefficient of reflection of four different artificial magnetic conductors corresponding to the curves, respectively, 50, 52, 54 and 56, as a function of the frequency of the incident electromagnetic wave.

The curves 50 and 52 correspond to artificial magnetic conductors for which the number n of frequency-selective surfaces is equal to four. The curves 54 and 56 correspond to artificial magnetic conductors for which the number n of frequency-selective surfaces is equal to three.

The curves 50 and 54 correspond to artificial magnetic conductors produced with radiant elements comprising at least one ferromagnetic sublayer. The curves 52 and 56 correspond to artificial magnetic conductors in which the resonant elements are only produced using a metal layer such as copper.

As revealed by the results of simulations illustrated in the graph of FIG. 5, the presence of a ferromagnetic sublayer makes it possible to reduce the resonance frequency $f_0$ compared to the case where such a sublayer is absent. Furthermore, the curves 50 and 54 are less steep than the curves 52 and 56 such that the passband of the corresponding artificial magnetic conductors is wider than those of the artificial magnetic conductors corresponding to the layers 52 and 56. Thus, the presence of at least one ferromagnetic sublayer makes it possible to widen the passband and reduce the resonance frequency $f_0$.

Figure 6:
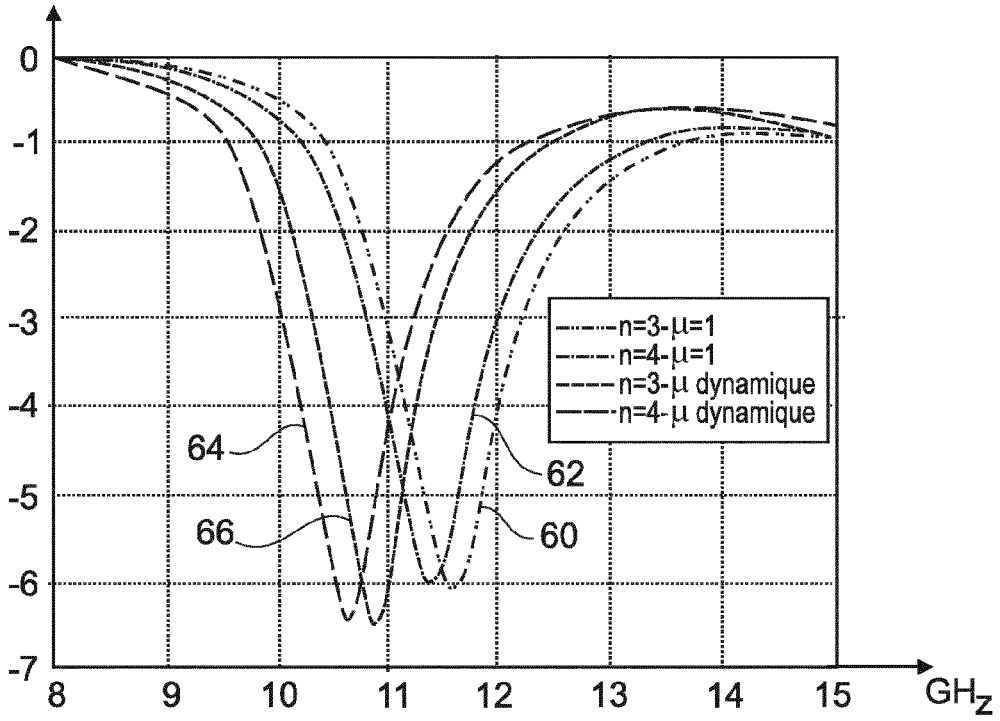
FIG. 6 is a graph illustrating the trend of the modulus of the reflection coefficient of the artificial magnetic conductor of FIG. 2 as a function of frequency.

The graph of FIG. 6 represents the trend of the modulus, expressed in decibels, of the coefficient of reflection of different artificial magnetic conductors as a function of the frequency of the incident electromagnetic wave.

The curves 60 and 62 each correspond to artificial magnetic conductors comprising only a stack of three frequency-selective surfaces.

The curves 64 and 66 correspond to artificial magnetic conductors comprising only a stack of four frequency-selective surfaces.

The curves 60 and 66 correspond to artificial magnetic conductors in which the resonant elements are only formed from a metal material such as copper.

The curves 62 and 64 correspond to artificial magnetic conductors in which the resonant elements comprise at least one ferromagnetic sublayer.

As illustrated in this graph, the presence of the ferromagnetic sublayer reduces the frequency for which the modulus of the coefficient of reflection is minimum.

Figure 7:
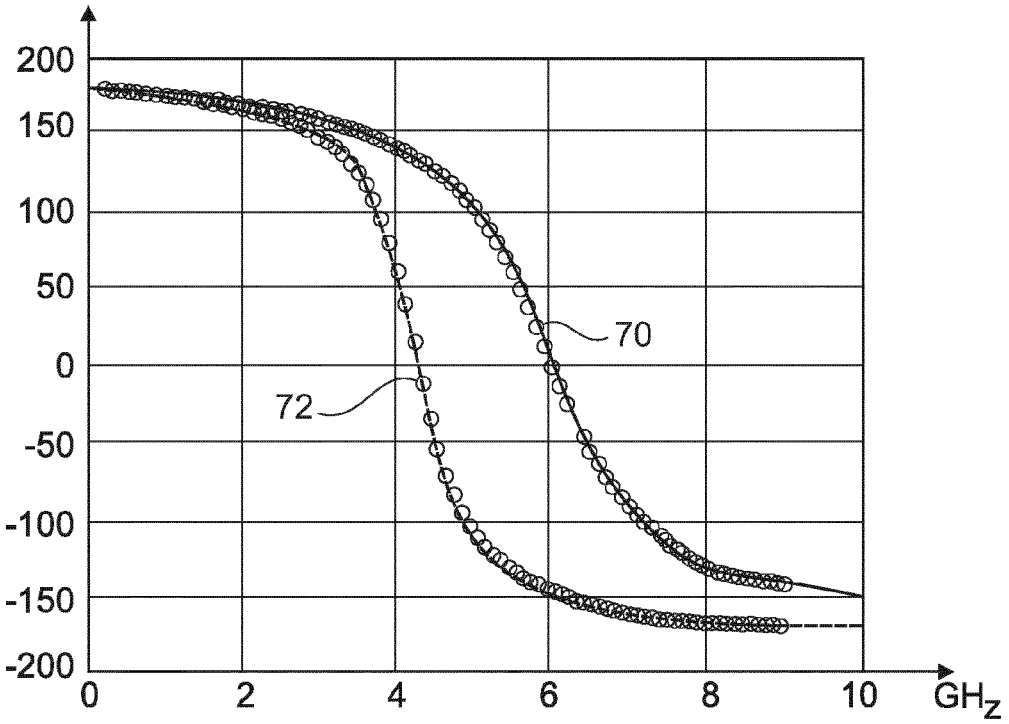
FIG. 7 is a graph illustrating the phase of the reflection coefficient as a function of the frequency in two different situations.

FIG. 7 represents a graph illustrating the trend of the phase of the coefficient of reflection (expressed in degrees) as a function of the frequency (expressed in GHz). The curve 70 corresponds to an artificial magnetic conductor that has only one frequency-selective surface whereas the curve 72 corresponds to an artificial magnetic conductor comprising a stack of several frequency-selective surfaces. As illustrated in this graph, the use of a stack of several frequency-selective surfaces significantly reduces the resonance frequency $f_0$ of the artificial magnetic conductor. This reduction of the frequency $f_0$ is particularly noticeable for a number n of frequency-selective surfaces between two and ten.

Figure 8:
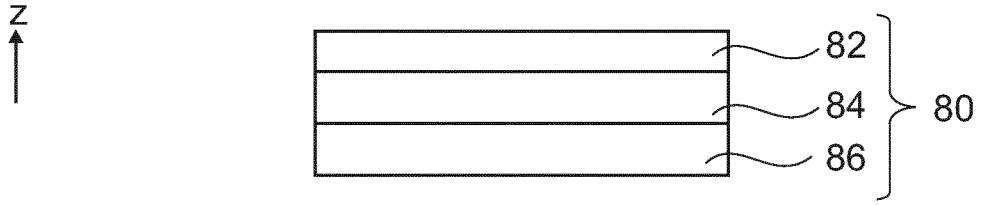
FIG. 8 is a schematic illustration in vertical cross section of a second embodiment of a resonant element.

FIG. 8 represents a resonant element 80 that can be used instead of the resonant element 14. The resonant element 80 is formed by a stack of several thin sublayers, including at least one sublayer produced in ferromagnetic material. For example, here, the resonant element 80 comprises a sublayer 82 of ferromagnetic material superposed on a sublayer 84 of dielectric material which is itself superposed on a sublayer 86 of metal.

The sublayers 82 and 84 exhibit, respectively, a relative permeability and a relative permittivity greater than 10 for a frequency of 2 or 3 GHz. These sublayers are, for example, produced as described with reference to the resonant element 14.

The sublayer 86 is, for example, produced in copper so as to limit the ohmic losses of the antenna.

Figure 9:
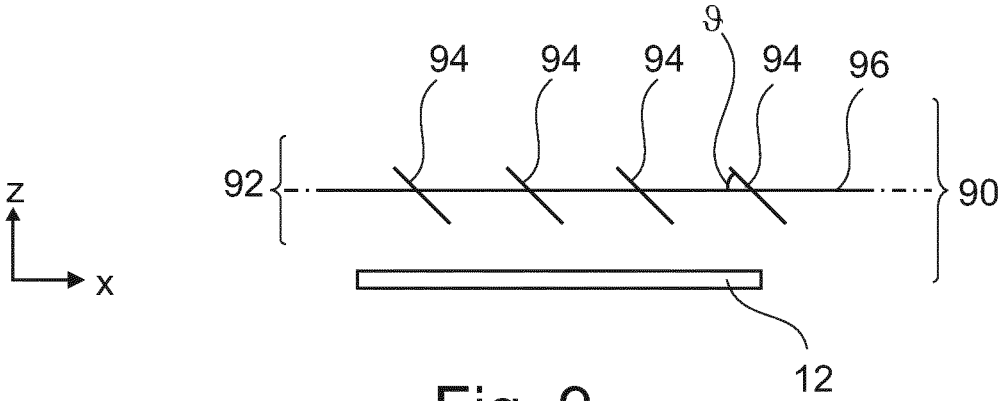
FIGS. 9 and 10 are schematic illustrations, in vertical cross section, of two other embodiments of the resonant elements of an artificial magnetic conductor.
Figure 10:
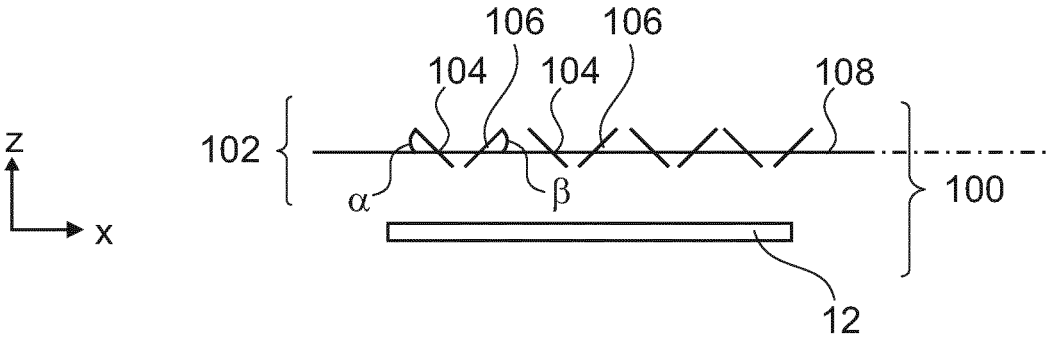

FIGS. 9 and 10 show two other embodiments of an artificial magnetic conductor. More specifically, FIGS. 9 and 10 represent artificial magnetic conductors, respectively 90 and 100. To simplify FIGS. 9 and 10, only the ground plane 12 has been represented and only one frequency-selective surface.

The artificial magnetic conductor 90 comprises a frequency-selective surface 92 provided with an array of resonant elements 94. These resonant elements 94 are aligned along a horizontal axis 96. Each resonant element 94 extends in a plane forming an angle θ with the ground plane 12. The angle θ is typically between −45° and +45° and, preferably, between [−45°; −5°] and [+5°; +45°].

The artificial magnetic conductor 100 comprises a frequency-selective surface 102 produced using resonant elements 104 and 106 aligned along a horizontal direction 108. As in the embodiment of FIG. 9, the elements 104 and 106 extend in planes forming angles, respectively α and β, with the ground plane 12. Here, the angles α and β are between −45° and +45° and, preferably, between [−45°; −5°] and [+5°; +45°]. However, in this embodiment, the angles α and β are different from one another. Preferably, they are chosen such that each resonant element 104 is symmetrical to a resonant element 106 relative to a vertical plane.

Numerous other embodiments are possible.

For example, the periodicity of the resonant elements is not necessarily the same in each frequency-selective surface. Similarly, the periodicity of the resonant elements in one direction of the array is not necessarily the same as the periodicity in another direction.

The materials used to produce the resonant elements of a frequency-selective surface are not necessarily the same as those used to produce the resonant elements of another frequency-selective surface of the same artificial magnetic conductor.

The thicknesses of the dielectric layers separating the frequency-selective surfaces can all be different or, on the contrary, all the same. Similarly, the dielectric material forming these dielectric layers can be the same for all the layers or different for one or more of these dielectric layers.

Numerous forms are possible for each resonant element. For example, they may be a square, orthogonal, diamond-shaped or dipole-shaped land. Generally, this form exhibits an axis of symmetry relative to an axis orthogonal to the plane in which most of this resonant element extends.

The resonant elements of a frequency-selective surface are not necessarily stacked strictly one above the other. For example, the axes of symmetry of the resonant elements of a lower frequency-selective surface may be offset in a horizontal direction relative to the axes of symmetry of the resonant elements of a higher frequency-selective surface.

All the resonant elements or only some can be electrically connected to the ground plane by vertical metal blocks known as "vias".

The resonant elements are not necessarily arranged periodically along one or two horizontal directions.

In a simplified embodiment, the second grouping and the dielectric sublayer of the resonant element 14 are omitted. In an even more simplified embodiment, the resonant element is made up of a single thin sublayer of ferromagnetic material with a thickness less than the skin thickness of this ferromagnetic material.

As a variant, other materials can be used as dielectric. For example, it may be an oxide of barium (Ba) and of titanium (Ti), in particular barium titanate $BaTiO_3$, an oxide of hafnium (Hf), in particular $HfO_2$, or of tantalum (Ta), in particular $Ta_2O_5$ (ferroelectric). Preference will nevertheless be given to the perovskites like $BaTiO_3$ or $SrTiO_3$ for example, which exhibit a higher relative permittivity (of the order of 100 as opposed to 10 for the oxides of barium or of hafnium at 2 or 3 GHz).

Other materials are also possible for the antiferromagnetic layer such as a PtMn or IrMn alloy and more generally, any manganese-based alloy or even the oxides of iron or of cobalt or of nickel.

For the ferromagnetic layer, the alloys CoFeB, FeN and CoFeN will be preferred, but other materials are possible, in particular all the alloys combining two or three of the elements chosen from iron, cobalt and nickel. These alloys may optionally be doped, for example with boron or nitrogen. They may also be associated with other elements such as Al, Si, Ta, Hf, Zr.

The radiant conductor may be a single wire. The conductor may replace one of the radiant elements of the front face.

The ground plane may be a second artificial magnetic conductor identical to the first artificial magnetic conductor and arranged symmetrically to the first artificial magnetic conductor relative to a plane of symmetry to form an electrical image of the first artificial magnetic conductor. In these conditions, the first artificial magnetic conductor operates as if there were a metal layer instead of the plane of symmetry. Thus, here, a "ground plane" denotes equally a metal layer uniformly distributed in a plane and a second artificial magnetic conductor symmetrical to the first artificial magnetic conductor relative to this plane. It will, however, be noted that the second artificial magnetic conductor radiates in the lower half-space situated below the plane of symmetry. Such an antenna therefore radiates in all of the space.

The invention claimed is:

1. An artificial magnetic conductor having a surface impedance greater than 100Ω, said artificial magnetic conductor comprising a ground plane, and a first frequency-selective surface that is transparent for certain wavelengths and reflective for a range of wavelengths, said first frequency-selective surface comprising an array of conductive resonant elements arranged alongside one another in at least two different directions parallel to said ground plane, wherein each conductive resonant element comprises a sub-layer of ferromagnetic material having a relative permeability greater than 10 at a frequency of 2 GHz and having a thickness less than the skin depth of said ferromagnetic material.

2. The artificial magnetic conductor of claim 1, wherein each conductive resonant element of said first frequency-selective surface comprises a stack of sub-layers, each of said sub-layers in said stack having a thickness that is less than 10 μm in a direction at right angles to said ground plane.

3. The artificial magnetic conductor of claim 2, wherein at least one sub-layer of each conductive resonant element comprises an antiferromagnetic sub-layer directly deposited at a location selected from the group consisting of on said ferromagnetic sub-layer and under said ferromagnetic sub-layer.

4. The artificial magnetic conductor of claim 2, wherein at least one sub-layer of each conductive resonant element comprises a dielectric material having a relative permittivity greater than 10 at a frequency of 2 GHz.

5. The artificial magnetic conductor of claim 2, wherein at least one sub-layer of each conductive resonant element comprises a metal sub-layer.

6. The artificial magnetic conductor of claim 5, wherein at least one sub-layer of each conductive resonant element comprises an antiferromagnetic sub-layer directly deposited at a location selected from the group consisting of on said ferromagnetic sub-layer and under said ferromagnetic sub-layer.

7. The artificial magnetic conductor of claim 1, further comprising at least one additional frequency-selective surface, wherein said frequency-selective surfaces of said artificial magnetic conductor are stacked one on top of the other in a direction at right angles to said ground plane, each of said frequency-selective surfaces comprising an array of conductive resonant elements arranged alongside one another in at least two different directions parallel to said ground plane and separated from one another by a layer of dielectric material having a thickness greater than 10 μm.

8. The artificial magnetic conductor of claim 7, wherein each conductive resonant element of each of said frequency-selective surfaces is formed by at least one sub-layer of a ferromagnetic material having a relative permeability greater than 10 at a frequency of 2 GHz and having a thickness less than the skin depth of said ferromagnetic material.

9. The artificial magnetic conductor of claim 1, wherein each conductive resonant element is electrically insulated from said ground plane by a layer of dielectric material.

10. The artificial magnetic conductor of claim 1, wherein each conductive resonant element extends along a plane that forms an angle with said ground plane, said angle being between five degrees and forty-five degrees.

11. An antenna comprising the artificial magnetic conductor as recited in claim 1, said artificial magnetic conductor having a resonance frequency, and a conductor suitable for radiating or for receiving electromagnetic waves at a working frequency that is between half of said resonance frequency and twice said resonance frequency, said conductor extending in a plane parallel to said artificial magnetic conductor and being separated from a closest frequency-selective surface of said artificial magnetic conductor by a distance less than one-tenth of a wavelength of an electromagnetic wave at said resonance frequency.

* * * * *